US007195085B2

(12) United States Patent
Pia

(10) Patent No.: US 7,195,085 B2
(45) Date of Patent: Mar. 27, 2007

(54) DRILL BIT

(75) Inventor: Giancarlo T. Pia, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/276,089

(22) PCT Filed: Jun. 27, 2001

(86) PCT No.: PCT/GB01/02858

§ 371 (c)(1),
(2), (4) Date: Nov. 15, 2002

(87) PCT Pub. No.: WO02/01037

PCT Pub. Date: Jan. 3, 2002

(65) Prior Publication Data

US 2003/0111267 A1 Jun. 19, 2003

(30) Foreign Application Priority Data

Jun. 28, 2000 (GB) ..... 0015714.9

(51) Int. Cl.
*E21B 7/28* (2006.01)
*E21B 10/34* (2006.01)

(52) U.S. Cl. ..... 175/263; 175/269; 175/287; 175/342; 175/353

(58) Field of Classification Search ..... 175/57, 175/263, 266, 267, 269, 284, 342, 384, 350, 175/353, 274, 271, 286, 287, 291, 382
See application file for complete search history.

(56) References Cited

U.S. PATENT DOCUMENTS 761,518 A 5/1904 Lykken
1,324,303 A 12/1919 Carmichael
1,545,039 A 7/1925 Deavers
1,561,418 A 11/1925 Duda
1,569,729 A 1/1926 Duda
1,597,212 A 8/1926 Spengler
1,930,825 A 10/1933 Raymond
2,049,450 A 8/1936 Johnson
2,060,352 A 11/1936 Stokes
2,216,895 A 10/1940 Stokes
2,324,679 A 7/1943 Cox
2,383,214 A 8/1945 Prout
2,499,630 A 3/1950 Clark (Continued)

FOREIGN PATENT DOCUMENTS

EP 0 961 007 12/1999

(Continued)

OTHER PUBLICATIONS

M. Gelfgat, "Retractable Bits Development and Application" Transactions of the ASME, vol. 120, Jun. 1998, pp. 124-130.

(Continued)

*Primary Examiner*—Kenneth Thompson
(74) *Attorney, Agent, or Firm*—Patterson & Sheridan, L.L.P.

(57) ABSTRACT

An expandable drill bit comprises a body for mounting on a support string and two roller cutters mounted on the body. The cutters are movable between a smaller diameter first configuration and a larger diameter second configuration. In one embodiment the bit is adapted to drill with the cutters in both the first and second configurations.

58 Claims, 4 Drawing Sheets

U.S. PATENT DOCUMENTS

| | | | | |
|---|---|---|---|---|
| 2,627,891 | A | 2/1953 | Clark | |
| 2,633,073 | A | 3/1953 | Allan | |
| 2,743,087 | A * | 4/1956 | Layne et al. | 175/285 |
| 2,898,971 | A | 8/1959 | Hempel | |
| 3,087,546 | A | 4/1963 | Woolley | |
| 3,195,646 | A | 7/1965 | Brown | |
| 3,387,893 | A * | 6/1968 | Hoever | 299/60 |
| 3,467,180 | A | 9/1969 | Pensotti | |
| 3,545,543 | A | 12/1970 | Kammerer, Jr. et al. | |
| 3,575,245 | A * | 4/1971 | Cordary et al. | 175/268 |
| 3,818,734 | A | 6/1974 | Bateman | |
| 3,911,707 | A | 10/1975 | Minakov et al. | |
| 3,934,660 | A * | 1/1976 | Nelson | 175/102 |
| 4,069,573 | A | 1/1978 | Rogers, Jr. et al. | |
| 4,127,168 | A | 11/1978 | Hanson et al. | |
| 4,159,564 | A | 7/1979 | Cooper, Jr. | |
| 4,189,185 | A | 2/1980 | Kammerer, Jr. et al. | 299/13 |
| 4,288,082 | A | 9/1981 | Setterberg, Jr. | |
| 4,324,407 | A | 4/1982 | Upham et al. | |
| 4,396,076 | A | 8/1983 | Inoue | |
| 4,429,620 | A | 2/1984 | Burkhardt et al. | |
| 4,531,581 | A | 7/1985 | Pringle et al. | |
| 4,588,030 | A | 5/1986 | Blizzard | |
| 4,604,818 | A | 8/1986 | Inoue | |
| 4,697,640 | A | 10/1987 | Szarka | |
| 4,848,469 | A | 7/1989 | Baugh et al. | |
| 4,904,119 | A | 2/1990 | Legendre et al. | 405/228 |
| 5,271,472 | A | 12/1993 | Leturno | |
| 5,361,859 | A * | 11/1994 | Tibbitts | 175/286 |
| 5,402,856 | A | 4/1995 | Warren et al. | |
| 5,409,059 | A | 4/1995 | McHardy | |
| 5,435,400 | A | 7/1995 | Smith | |
| 5,472,057 | A | 12/1995 | Winfree | |
| 5,560,426 | A | 10/1996 | Trahan et al. | |
| 5,685,369 | A | 11/1997 | Ellis et al. | |
| 5,901,787 | A | 5/1999 | Boyle | |
| 6,021,850 | A | 2/2000 | Wood et al. | |
| 6,098,717 | A | 8/2000 | Bailey et al. | |
| 6,325,148 | B1 | 12/2001 | Trahan et al. | |
| 6,425,444 | B1 | 7/2002 | Metcalfe et al. | |
| 6,446,323 | B1 | 9/2002 | Metcalfe et al. | |
| 6,457,532 | B1 | 10/2002 | Simpson | |
| 6,457,533 | B1 | 10/2002 | Metcalfe | |
| 6,527,049 | B2 | 3/2003 | Metcalfe et al. | |
| 6,543,552 | B1 | 4/2003 | Metcalfe et al. | |
| 6,543,816 | B1 | 4/2003 | Noel | |
| 6,629,568 | B2 | 10/2003 | Post et al. | |
| 6,702,029 | B2 | 3/2004 | Metcalfe et al. | |
| 2002/0163192 | A1 | 11/2002 | Coulon et al. | |
| 2003/0111234 | A1 | 6/2003 | McClurkin et al. | |
| 2003/0141111 | A1 | 7/2003 | Pia | |
| 2003/0146023 | A1 * | 8/2003 | Pia | 175/269 |
| 2003/0150608 | A1 | 8/2003 | Smith, Jr. et al. | |
| 2003/0168222 | A1 | 9/2003 | Maguire et al. | |
| 2003/0183424 | A1 * | 10/2003 | Tulloch | 175/263 |
| 2003/0230410 | A1 | 12/2003 | Underhill | |
| 2004/0020660 | A1 | 2/2004 | Johnson et al. | |
| 2004/0124011 | A1 * | 7/2004 | Gledhill et al. | 175/57 |
| 2004/0159446 | A1 | 8/2004 | Haugen et al. | |
| 2004/0177953 | A1 | 9/2004 | Wubben | |
| 2005/0045342 | A1 | 3/2005 | Luke et al. | |
| 2006/0032671 | A1 * | 2/2006 | Arzberger | 175/57 |

FOREIGN PATENT DOCUMENTS

| | | |
|---|---|---|
| GB | 540027 | 10/1941 |
| GB | 838833 | 6/1960 |
| GB | 1 485 099 | 9/1977 |
| GB | 2 086 282 | 5/1982 |
| GB | 2320270 | 6/1998 |
| GB | 2 320 734 | 7/1998 |
| GB | 2 383 361 | 6/2003 |
| GB | 2 388 137 | 11/2003 |
| SU | 112631 | 1/1956 |
| SU | 695260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 1304470 | 8/1984 |
| SU | 1808972 | 5/1991 |
| SU | 1740602 A1 * | 6/1992 |
| WO | WO 84/00120 | 1/1984 |
| WO | WO 93/24728 | 12/1993 |
| WO | WO 99/18328 | 4/1999 |
| WO | WO 99/23354 | 5/1999 |
| WO | WO 00/37766 | 6/2000 |
| WO | WO 01/38693 | 5/2001 |
| WO | WO 02/059456 | 8/2002 |

OTHER PUBLICATIONS

Dean E. Gaddy, Editor, "Russia Shares Technical Know-How with U.S." Oil & Gas Journal, Mar. 1999, pp. 51-52 and 54-56.

Canadian Office Action, Application No. 2,413,377, dated Jul. 11, 2005.

EP Examination Report, Application No. 01 940 850.9-2315, dated Nov. 29, 2005.

Canadian Search Report, Application No. 2,413,377, dated Mar. 9, 2006.

* cited by examiner

DRILL BIT

CROSS-REFERENCE TO RELATED APPLICATIONS

This application claims benefit of PCT patent application number PCT/GB01/02858 filed Jun. 27, 2001. PCT application number PCT/GB01/02858 claims benefit of Great Britain patent application number 0015714.9 filed Jun. 28, 2000.

BACKGROUND OF THE INVENTION

1. Field of the Invention

This invention relates to drill bits. Aspects of the invention relate to both fixed and expandable drill bits.

2. Description of the Related Art

Deep bores, for example, as utilized to access subsurface hydrocarbon-bearing formations, are conventionally drilled using drill bits mounted on the end of a string of drill pipe, the drill pipe being rotated from surface. It is also known to drill bores using drill bits driven by downhole motors, and to mount drill bits on relatively flexible coil tubing. There are currently two main drill bit forms in common usage, that is roller cone bits and fixed cutter bits, the former cutting primarily by a crushing action and the latter relying primarily upon a shearing action.

In drilling deep bores, it is common to drill a section of bore and then line or case the bore before drilling further. Using a conventional fixed diameter bit, any subsequent drilling produces a relatively small diameter bore; the drill bit must be able to pass down through the cased section of bore, and must therefore be of smaller diameter than the casing. Such a loss of diameter may be minimized by, for example, using a bi-centre bit, or by providing an expandable bit. However, use of a bi-centre bit generally must be preceded by drilling a short pilot hole which must then be under reamed to accommodate the bit. Also, although numerous expandable bits have been proposed, these are of complex construction and the applicant is unaware of any such bit in current commercial usage.

It is among the objectives of embodiments of the present invention to obviate or mitigate such disadvantages, and one aspect of the invention relates to an improved expandable drill bit arrangement.

SUMMARY OF THE INVENTION

According to a first aspect of the present invention, there is provided an expandable drill bit comprising:

a body for mounting on a support string; and at least two roller cutters mounted on the body, the cutters being movable between a smaller diameter first configuration and a larger diameter second configuration.

Thus, the bit may be run into a cased bore, and through bore restrictions, while in the first configuration, and then extended to the second configuration to cut a bore of greater diameter than the casing or bore restrictions. In certain embodiments the drill bit may also be utilized for back-reaming, that is pulling the bit back through a bore and enlarging the bore diameter.

Other aspects of the invention relate to methods of drilling a bore of greater diameter than a bore restriction above the drilling location utilizing an expandable roller cutter drill bit.

Preferably, two cutters are provided. Most preferably, inner ends of the cutters overlap, such that the cutting area swept by the cutters is, in at least some configurations, a complete circle. In other embodiments; three or more cutters may be provided.

Preferably, the bit is adapted to drill with the cutters in both the first and second configurations. In one embodiment, this permits the bit to be utilized to drill a smaller diameter pilot hole with the cutters in the first configuration and then to extend the pilot hole to a larger diameter with the cutters in the second configuration. The bit may also be adapted to drill with the cutters in intermediate configurations, between the first and second configurations, to drill bores of intermediate diameters. For such embodiments, it is preferred that the faces of the cutters for contact with the rock always describe a complete swept circle as the bit is rotated; otherwise, in some configurations the cutters will, for example, describe an annular area leaving a central area of uncut rock. Alternatively, the bit may be adapted to drill only with the cutters in the second configuration, or only in extended configurations. As, with these latter embodiments, there is no requirement for the cutters to operate in the first configuration, the cutter configuration may be optimized for drilling relatively large diameter bores.

Preferably, the cutters are in the form of cones. The cones may be tapered, barrelled, or define some other profile. Most preferably, the cones each define a shoulder and a maximum diameter portion intermediate the cone ends: In preferred embodiments, the cones are arranged such that the cone maximum diameter portion cuts the diameter of the bore.

Each cutter may be rotatable about its main axis, or may be rotatable about an offset axis to provide for eccentric cutter motion and a "hammer" cutting effect.

Preferably, the cutter length is at least 50% of the body diameter, and the cutter length may be equal to or greater than the body diameter.

The cutters may be provided with any appropriate cutting structures, inserts or facings, including tungsten carbide buttons or blocks, poly crystalline diamond compacts or natural diamond, secured or fixed to the cutters by any appropriate method. The cutting structures may be arranged in parallel rows or indeed any appropriate pattern or random placement.

Preferably, the cutters are arranged to allow intermeshing of the cutting structures on each cone.

Preferably, the cutters are rotatable around a non-radial axis. The cutters thus provide a shearing or scooping action as the bit is rotated. The cutter axes are preferably parallel, but may be convergent or divergent. Preferably, each cutter axis lies in a plane which is non-perpendicular to the body axis, although the cutter axes may be perpendicular to the body axis to provide a less aggressive cutting action.

Preferably, the cutters are mounted on arms pivotally mounted to the body. The cutter axes may lie in a plane which is non-parallel to the bit body lateral axis which is perpendicular to the pivot axis or axes. This facilitates provision of a circular swept cutting area, and the avoidance of an uncut area as the cutters are extended. In other embodiments, particularly when the bit is capable of drilling in both first and second configurations, the cutter axes may lie in a plane which is parallel to the bit body axis; any area left unswept with the cutters in the second configuration will have already been removed by the drilling of a pilot hole with the cutters in the first configuration. The arms may be mounted on a common pivot axis.

Preferably, the cutters are supported at both ends, and most preferably provided with bearings and seals at both ends, and are thus likely to be more robust than a conventional roller cone bit, in which the cutters are supported at only one end.

Preferably, the bit includes means for actuating the cutters between the first and second configurations. The means may be actuated by any appropriate method, including mechanical actuation, but is preferably fluid pressure actuated, and may include a drilling fluid actuated piston arrangement, or some other arrangement such as a bore restriction or a profile adapted to catch a ball or other restriction. Where a piston arrangement is utilized, two or more "intensifier" pistons may be provided, to increase the available applied forces. Most preferably, the means may be selectively operated, for example by use of a cam track and follower arrangement, and may be selectively locked or held in one or both configurations. Most preferably, the means is adapted to selectively positively retract the cutters from the second configuration. The actuating means may include a spring or other arrangement such that the means is biased to urge the cutters to assume the first configuration.

The body or other components, for example, cone shafts, may define a lubricant reservoir for supplying lubricant to bearings and other moving parts provided in the bit, and the reservoir may include a drilling fluid actuated piston or other mechanism which serves to pump lubricant to the required locations.

The body may define jetting nozzles, which nozzles may be selectively opened or closed depending on the configuration of the cutters, thus altering the back pressure produced by the bit, and providing an indication at surface of the cutter configuration. The nozzles may direct fluid onto the cone surfaces, and towards the bottom or sides of the bore.

The bit may define cutting faces in addition to those provided by the cutters, for example the body or cutter supporting arms may define a cutting faces.

Many of these various preferred features of the first aspect of the invention may also be utilized to advantage in a fixed diameter drill bit or in bits not in accordance with the various aspects of the invention set out above, and bits including selected ones of these features, and the features of the dependent claims set out below, provide further aspects of the present invention.

BRIEF DESCRIPTION OF THE DRAWINGS

These and other aspects of the present invention will now be described, by way of example, with reference to the accompanying drawings, in which.

DETAILED DESCRIPTION

Figure 1:
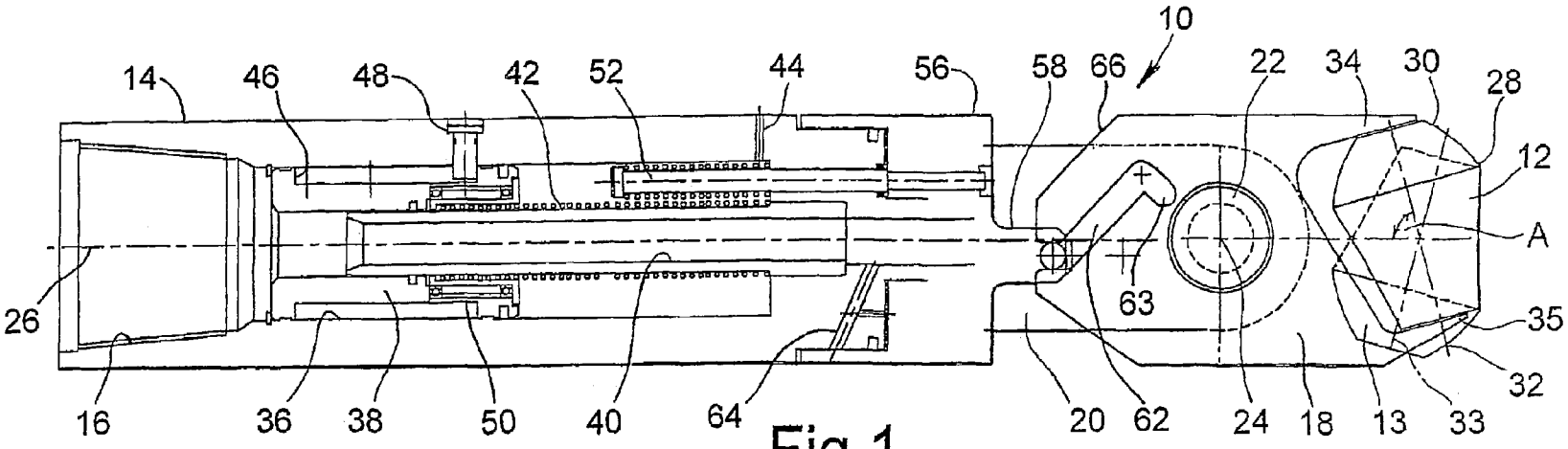
FIG. 1 is a part-sectional view of a drill bit in accordance with an embodiment of the present invention, shown in a first configuration.
Figure 2:
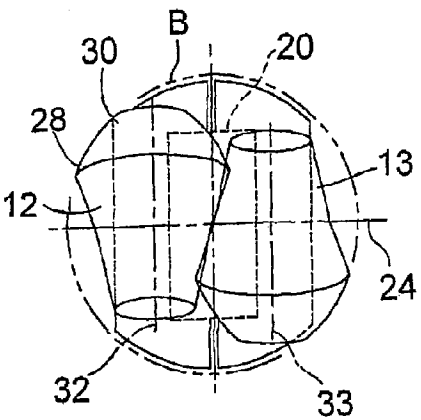
FIG. 2 is a view from below of the drill bit of FIG. 1.
Figure 3:
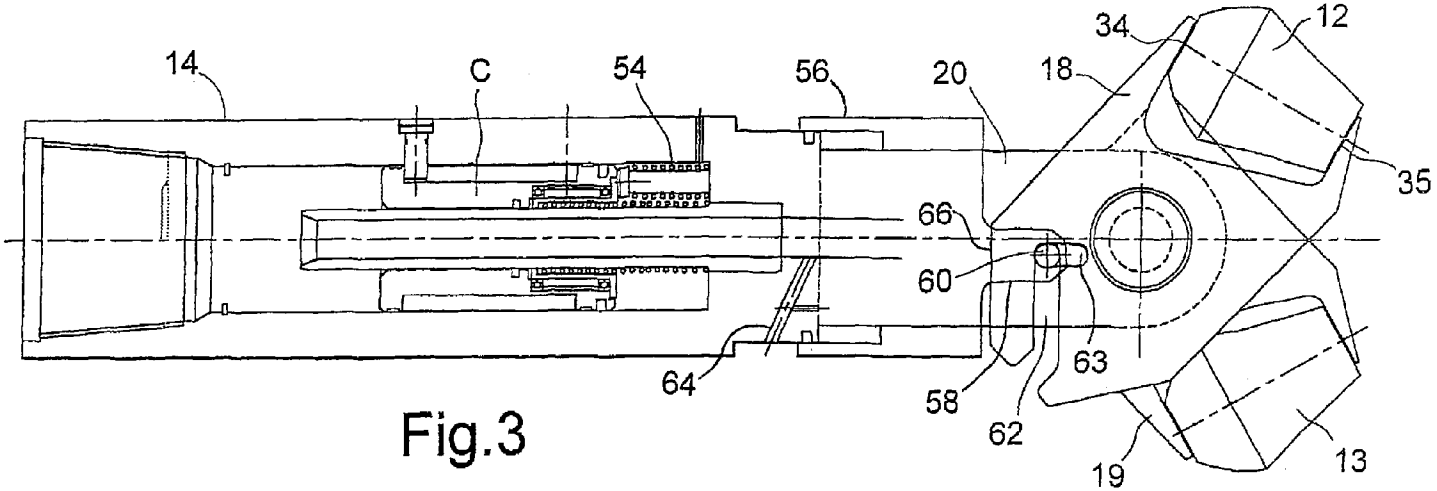
FIG. 3 is a part-sectional view of the drill bit of FIG. 1 in a second configuration.
Figure 4:
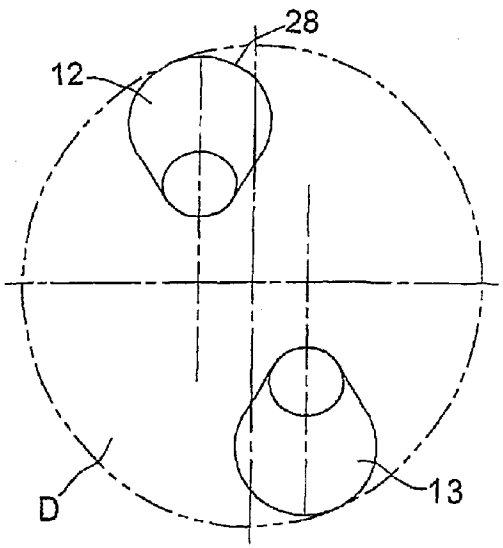
FIG. 4 is a view from below of the drill bit of FIG. 3.
Figure 5:
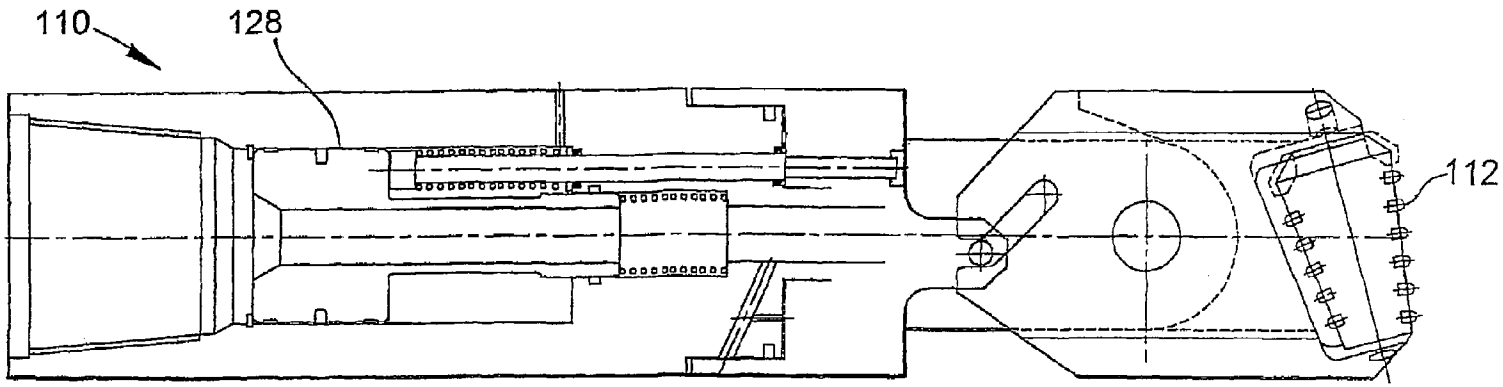
FIG. 5 is a part-sectional view of a drill bit in accordance with another embodiment of the present invention, shown in a first configuration.
Figure 6:
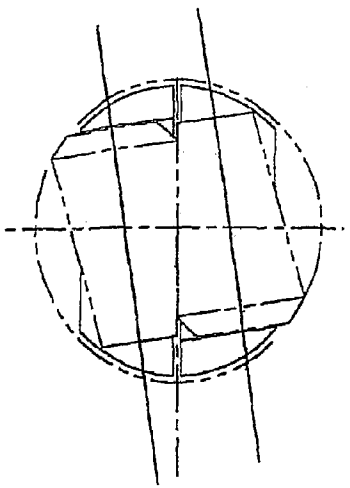
FIG. 6 is a view from below of the drill bit of FIG. 5.

The reference is first made to FIG. 1 of the drawings, which illustrates a drill bit 10 in accordance with a preferred embodiment of the present invention. As will be described, the bit 10 comprises conical roller cutters 12, 13 which are movable between a smaller diameter first configuration, as shown in FIGS. 1 and 2, and a larger diameter second configuration, as shown in FIGS. 3 and 4. This allows the bit 10 to pass through bore restrictions and then be extended to cut larger diameter bores, as will be described.

The bit 10 comprises a generally cylindrical body 14 adapted for mounting on the end of a drill string. As illustrated, the body 14 is provided with a box-type connector 16 for engaging a pin-type connector on the end of a drill string. The cutters 12 are mounted on the lower end of the body 14 by respective pivoting arms 18, 19. The lower end of the body 14 is in the form of an extension 20 which provides mounting for a pivot pin 22 on which the arms 18, 19 are mounted, the arms each featuring a clevis-like arrangement such that the arms each engage the pin at two spaced locations on opposite sides of the extension 20. The pivot pin 22 is arranged such that the pivot axis 24 of the arms 18, 19 intersects and lies at right angles to the body axis 26.

The cutters 12, 13 each define a maximum diameter portion 28 intermediate the cutter ends, and define a shoulder 30 between the portion 28 and the cutter outer end. The cutters 12, 13 are mounted on shafts (not shown) extending along the respective cutter axes 32, 33, the shafts being supported at both ends by fingers 34, 35 extending from the ends of the arms 18, 19. It will be noted from FIG. 1 that the cutter axes 32 lie in a plane which is at an acute angle A to the body axis 26, and from FIG. 2 that the cutter axes 32, 33 lie in mutually parallel vertical planes.

The bit 10 is adapted to be capable of cutting in the first configuration, and the swept area of the cutters 12, 13 is illustrated by chain dotted line B in FIG. 2. It will be evident that the diameter of the swept circle is defined by the cutter maximum diameter portions 28, which will cut a bore of greater diameter than the bit body 14.

The cutters 12, 13 are moved between the first configuration, as illustrated in FIGS. 1 and 2, and the second configuration, as illustrated in FIGS. 3 and 4, by application of drilling fluid pressure, as will now be described. The body is partially hollow and defines an axial generally cylindrical chamber 36 which accommodates an annular piston 38 mounted around a central locating sleeve 40, the lower end of the sleeve being fixed to the body 14. The portion of the chamber 36 below the piston 38 accommodates a spring 42, for urging the piston 38 to an upper position, and this portion of the chamber is also in communication with the body exterior, via vent port 44. The piston 38 is movable in response to fluid pressure within the body 14, however the axial movement of the piston 38 is governed by a cam profile 46 formed in the outer surface of the piston 38 and which co-operates with a cam pin 48 mounted in the body wall. Thus, as the fluid pressure within the body is cycled, the piston 38 will move axially and rotationally as permitted by the inter-engagement of the cam profile 46 and the pin 48, the accompanying rotation of the piston 38 being facilitated by the provision of a bearing 50 between the lower end of the piston 38 and the spring 42.

The cam profile 46 is arranged such that the piston 38 will only advance to extend the cutters 12, 13 at selected points in a pressure cycle. On other occasions the cam profile 46 is arranged to limit the forward axial movement (to location C) to prevent extension of the cutters, thus allowing circulation of drilling fluid, and drilling, while the cutters 12, 13 remain in the first configuration. However, when the cam profile 46 is in a selected orientation, the piston 38 may advance to the position as illustrated in FIG. 3, to fully extend the cutters 12, 13. In other embodiments of the invention the cam profile may be selected to allow the cutters 12, 13 to extend in incremental steps, that is the cutters 12, 13 may be positively located in intermediate positions, between the first and second configurations.

In its advanced position, the lower end of the piston 38 engages the head of rod 52 which extends into the body chamber 36, like the piston 38 the rod 52 being biased by a spring 54 towards a cutter retracted configuration. The rod 52 extends through the body 14 to engage a skirt 56 mounted around the body extension 20. The skirt 56 features two axially extending lugs 58 (only one shown) on either side of the body extension, each lug 58 carrying a cam pin 60 located in a cam slot 62 in the upper end of a respective cutter mounting arm 18, 19.

Thus, when permitted by the cam profile 46, advancement of the piston 38 produces corresponding movement of the rod 52 and the skirt 56. As the sleeve cam pins 60 are offset from the pivot axis 24, axial movement of the pins 60 causes the arms 18, 19 to pivot outwardly to move the cutters 12, 13 towards the larger diameter second configuration as illustrated in FIGS. 3 and 4. However, to minimize unnecessary stresses of the pins 60, the pins 60 do not travel to the ends of the slots 62. The provision of cam slots 62 in the arms 18, 19 also provides the advantage that the arms will be positively retracted, in response to the action of the spring 54, when the fluid pressure drops to allow the rod 52 to retract into the body 14.

It will also be noted that the blind end of the slots 62 includes a short extension 63 lying perpendicular to the remainder of the slot, and which extension 63 lies longitudinally of the bit 10 when the cutters 12, 13 are fully extended. Thus, the movement of the skirt 56 corresponding to the end of the stroke of the piston 38 does not induce any corresponding rotation of the arms 18, 19, rather this movement brings the skirt 56 into engagement with an opposing face 66 defined by the arms 18, 19. These faces 66 act as stops and serve to transfer forces to the skirt 56 from the arms 18, 19, and reduce the load transferred to the pivot pin 22 (FIG. 3 shows the face 66 and the end of the skirt spaced apart). Furthermore, the faces serve to lock the cutters 12, 13 in the extended configuration, which is especially useful if the bit is configured to allow back reaming.

As the skirt 56 is pushed downwardly, drilling fluid ports 64 are opened, allowing fluid to flow from the body. This results in a drop in the fluid pressure within the body, which pressure drop is detectable at surface, providing an indication that the cutters 12, 13 have been moved to the second configuration. If desired, a number of outlet ports may be provided behind the skirt 56, which ports are opened in sequence as the skirt 56 advances as the cutters 12, 13 are moved between the first and second positions. Thus, the resulting pressure drops may be utilized as an indicator of the degree of extension of the cutters 12, 13. Further, the flow of fluid from the ports 64 also tends to flush cutting from behind the skirt 56, preventing jamming of the skirt 56 when the cutters are retracted. In addition, prior to the skirt 56 moving downwardly, fluid pressure acts on the skirt via the ports 64, the skirt 56 acting as a piston and facilitating initial extension of the cutters 12, 13.

The arms 18, 19 define faces 66 adapted to engage the body extension 20 when the arms 18, 19 are in the fully extended position. The engagement between the faces 66 and the body extension 20 limits the travel of the arms 18, 19, and also serves to relieve some of the stress applied to the pivot pin 22 and the arm actuating arrangement when weight is applied to the bit 10 during drilling.

In use, the bit 10 may be used, for example, to drill a section of bore below a previously cased bore section. In this event, the bit 10 is selected to be of smaller diameter than the casing internal diameter, to allow the bit 10 to be run into the bore. On reaching the lower end of the cased bore section, drilling fluid is pumped through the supporting string into the bit 10, where it exits the bit 10 through various jetting nozzles (not shown), and the string and bit 10 are rotated from surface. The cutters 12, 13 rotate around the end face of the bore, crushing the rock on the face, which is then removed by the drilling fluid. In this manner, the bit 10 may be utilized to drill a pilot bore. The bit 10 may then be pulled back to just below the end of the cased bore section, and the drilling fluid pressure cycled such that the piston 28 is rotated to a position where the cam profile 46 permits the piston 38 to fully extend. The drilling fluid pressure is increased such that the piston 38 is moved downwardly against the action of the springs 42, 54, and the cutters 12, 13 are urged towards the extended second configuration. The cutters 12, 13 may be unable to be fully extended immediately, however if the bit 10 is rotated the cutters 12, 13 may cut radially outwardly, until the cutters 12, 13 achieve their maximum extension. The bit 10 may then be advanced axially, and in this configuration the cutters 12, 13 will cut an annular area D, to extend the diameter of the existing pilot hole.

It will be apparent to those of skill in the art that the arm and cutter configuration may be varied to provide different cutting configurations. However, where it is desired to support the cutters at both ends, care is necessary to ensure that the fingers 34, 35 do not foul the bore wall, and lie within the swept area of the cutters 12, 13.

Reference is now made to FIGS. 5, 6, 7 and 8 of the drawings, which illustrate a drill bit 110 in accordance with another embodiment of the present invention. The bit 110 shares many features with the bit 10 described above. Accordingly, in the interests of brevity, features of structure and operation common to both bits 10, 110 will not be described again in great detail, and corresponding features of the bit 110 will be identified with the same reference numerals, prefixed by a "1".

Figure 7:
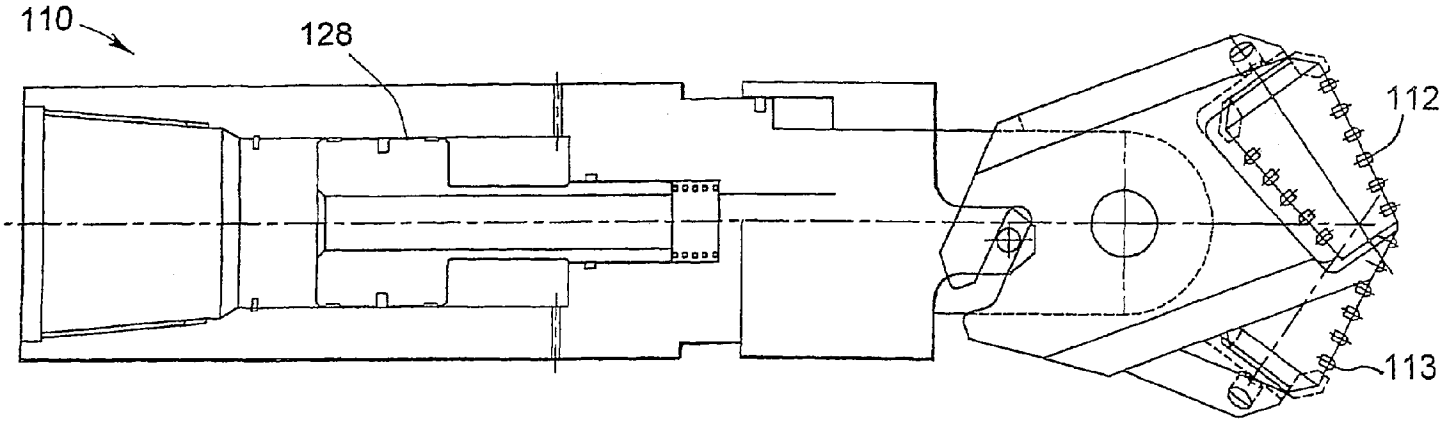
FIG. 7 is a part-sectional view of the drill bit of FIG. 5 in a second configuration.
Figure 8:
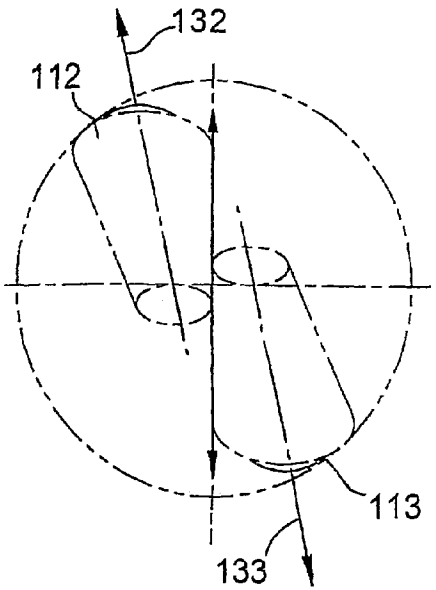
FIG. 8 is a view from below of the drill bit of FIG. 7.

The bit 110 is intended primarily to be used for drilling with the cutters 112, 113 in the second configuration (as shown in FIGS. 7 and 8). Thus, the cutters 112, 113 may have a longer profile, and the cones axes 132, 133 are located in planes which are non-parallel to the bit body lateral axis which is perpendicular to the arm pivot axis. However, the cutter inside edges lie on this bit body lateral axis, and move along this axis as the cutters 112, 113 are extended. This ensures that the swept area of the cutters 112, 113 is a complete circle, and there is no area left uncut between the cutters 112, 113.

The bit 110 also features a simplified piston arrangement, in that there is no cam arrangement for controlling movement of the piston 128: the piston 128 simply moves axially in response to changes in drilling fluid pressure.

It will be apparent to those of skill in the art that the above-described embodiments are merely exemplary of the present invention, and that various modifications and improvements may be made thereto, without departing from the scope of the present invention. In particular, many features of the expandable bits as described above may also be utilized in a fixed diameter bit. Also, bits made in accordance with the various aspects of the present invention may be configured to permit the bits to be used for back reaming. For such bits, it is desirable that the cutters may be positively retained in the second configuration, as is that case in the first described embodiment of FIGS. 1 to 4. In addition or as alternative to providing the arms with a locking face 66 to engage the skirt 56, the skirt and arms may feature cooperating profiles, such as castellations or lugs.

The invention claimed is:

1. An expandable drill bit comprising:

a body; and at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure, and wherein the bit is adapted to drill with the at least one cutter in at least one intermediate configuration, between the first and second configurations.

2. The drill bit of claim 1, wherein one or more faces of the at least one cutter during drilling always describes a substantially complete swept circle as the bit is rotated.

3. The drill bit of claim 1, wherein the at least one cutter is rotatable about its main axis.

4. The drill bit of claim 1, wherein the at least one cutter is rotatable about an offset axis to provide for eccentric cutter motion and a hammer cutting effect.

5. The drill bit of claim 1, wherein the at least one cutter axis lies in a plane which is non-perpendicular to a main body axis.

6. The drill bit of claim 1, wherein the at least one cutter axis is perpendicular to a body axis.

7. The drill bit of claim 1, wherein the at least one cutter includes two ends and wherein the at least one cutter is supported at both ends.

8. The drill bit of claim 1, wherein the at least one cutter includes two ends and wherein the at least one cutter is provided with bearings at both ends.

9. The drill bit of claim 1, wherein the complete swept bore comprises the entire area within the bore.

10. The drill bit of claim 1, wherein the complete swept bore extends from a central axis of the bore to the larger diameter.

11. The drill bit of claim 1, wherein the diameter of the at least one cutter in the first configuration is approximately equal to or less than an outer diameter of the body.

12. The drill bit of claim 1, wherein the drill bit is usable to drill a complete swept bore in an undrilled portion of the earth.

13. The drill bit of claim 1, wherein the at least one cutter is capable of back reaming when the at least one cutter is in the second configuration.

14. The drill bit of claim 1, wherein at least one cutter is adapted to form a bore while in the first configuration using a first fluid pressure and expand the bore while in the second configuration using a second fluid pressure.

15. The drill bit of claim 1, wherein at least two roller cutters are provided.

16. The drill bit of claim 15, wherein inner ends of the at least two cutters overlap.

17. The drill bit of claim 15, wherein the at least two cutters are arranged to allow intermeshing of cutting structures on each cutter.

18. The drill bit of claim 15, wherein the at least two cutters are rotatable about respective non-radial axes.

19. The drill bit of claim 18, wherein the at least two cutter axes are parallel.

20. The drill bit of claim 18, wherein the at least two cutter axes are non-parallel.

21. The drill bit of claim 15, wherein the at least two cutters are mounted on arms pivotally mounted to the body, the arms mounted on a common pivot axis.

22. The drill bit of claim 21, wherein the common pivot axis is defined by a common pivot pin.

23. The drill bit of claim 1, wherein the at least one cutter is in the form of a cone.

24. The drill bit of claim 23, wherein the cone defines a shoulder and a maximum diameter portion intermediate ends of the cone.

25. The drill bit of claim 24, wherein the cone is arranged such that the cone maximum diameter portion cuts the diameter of the bore.

26. The drill bit of claim 1, wherein the cutter length is at least 50% of the body diameter.

27. The drill bit of claim 26, wherein the cutter length is equal to or greater than the body diameter.

28. The drill bit of claim 1, wherein the at least one cutter is mounted on an arm pivotally mounted to the body.

29. The drill bit of claim 28, wherein at least one cutter axis lies in a plane which is non-parallel to a main bit body lateral axis which is perpendicular to a pivot axis the arm.

30. The drill bit of claim 28, wherein a at least one cutter axis lies in a plane which is parallel to a main bit body lateral axis which is perpendicular to a pivot axis of the arm.

31. The drill bit of claim 28, wherein the arm is mounted on a pivot pin and the arm engages the pivot pin at two spaced locations of the arm.

32. The drill bit of claim 28, wherein the arm defines one or more support faces and with the at least one cutter in the second configuration the support faces engage a part of the body, the faces acting as stops and serving to transfer forces to the body.

33. The drill bit of claim 1, further comprising an actuating mechanism for actuating the at least one cutter between the first and second configurations.

34. The drill bit of claim 33, wherein the actuating mechanism is adapted to selectively positively retract the at least one cutter from the second configuration.

35. The drill bit of claim 33, wherein the actuating mechanism includes an arrangement such that the actuating mechanism is biased to urge the at least one cutter to assume the first configuration.

36. The drill bit of claim 33, wherein the actuating mechanism includes a drilling fluid actuated piston arrangement.

37. The drill bit of claim 36, wherein the drilling fluid actuated piston arrangement comprises at least one piston.

38. The drill bit of claim 37, wherein the at least one piston is annular and defines a throughbore to permit fluid passage therethrough.

39. The drill bit of claim 33, wherein the actuating mechanism includes a cam profile and piston.

40. The drill bit of claim 39, wherein the cam profile is configurable to retain the at least one cutter in the first configuration.

41. The drill bit of claim 39, wherein the cam profile is configurable to retain the at least one cutter in at least one intermediate position between the first and second configurations.

42. The drill bit of claim 33, wherein the actuating mechanism comprises an axially movable skirt.

43. The drill bit of claim 42, wherein the skirt defines a piston area which, in use, is exposed to internal body fluid pressure, such that an increase in such pressure tends to extend the skirt, and thus move the at least one cutter towards the second configuration.

44. A drilling method comprising:

providing an expandable drill bit comprising a body and at least one cutter mounted on the body, the at least one cutter initially being in a smaller diameter first configuration;

drilling a bore using the at least one cutter in the first configuration;

changing a drilling fluid pressure to move the at least one cutter from the first configuration to a larger diameter second configuration; and expanding the bore using the at least one cutter in the second configuration, wherein the expandable bit is adapted to drill with the at least one cutter in at least one intermediate configuration between the first and second configurations.

45. The method of claim 44, wherein the drill bit is run into a cased bore.

46. The method of claim 44, further comprising cutting into the earth while the at least one cutter moves from the first configuration to the second configuration.

47. The expandable drill bit of claim 44, wherein at least two roller cutters are mounted on the body.

48. The method of claim 44, wherein in the first configuration, the smaller diameter is equal to or greater than a diameter of the body.

49. The method of claim 44, further comprising mechanically locking the at least one cutter in the second configuration prior to drilling the bore with the at least one cutter in the second configuration.

50. An expandable drill bit comprising:

a body;

at least two cutters mounted on the body, the at least two cutters being movable between a smaller diameter first configuration and a larger diameter second configuration and adapted to drill along an axial centerline of the drill bit with the at least two cutters in both the first and second configurations, wherein the at least two cutters are mounted on arms pivotally mounted to the body; and an axially movable skirt for actuating the at least two cutters between the first and second configurations, wherein the skirt is configured to positively engage with the arms to mechanically lock the at least two cutters in at least one of the second configuration or intermediate configuration.

51. An expandable drill bit comprising:

a body; and at least two cutters mounted on the body, the at least two cutters being movable between a smaller diameter first configuration and a larger diameter second configuration and adapted to drill along an axial centerline of the drill bit with the at least two cutters in both the first and second configurations, wherein the body defines fluid outlets configurable to be selectively opened or closed, depending on the configuration of the at least two cutters, and wherein, in use, the cutter configuration may be determined from surface by monitoring the resulting fluid back pressure.

52. An expandable drill bit comprising:

a body; and at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure and wherein the at least one cutter is rotatable about an offset axis to provide for eccentric cutter motion and a hammer cutting effect.

53. An expandable drill bit comprising:

a body; and at least two cutters mounted on the body, the at least two cutters being movable between a smaller diameter first configuration and a larger diameter second configuration and adapted to form a bore in both the first and second configurations, wherein the at least two cutters are moved between the first configuration and the second configuration by changing drilling fluid pressure and wherein the at least two cutters are rotatable about respective non-radial axes and the at least two cutter axes are non-parallel.

54. An expandable drill bit comprising:

a body; and at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure and is mounted on an arm pivotally mounted to the body, wherein the arm is mounted on a pivot pin and the arm engages the pivot pin at two spaced locations of the arm.

55. An expandable drill bit comprising:

a body;

at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure; and an actuating mechanism for actuating the at least one cutter between the first and second configurations, wherein the actuating mechanism includes a drilling fluid actuated piston arrangement comprising at least one piston that is annular and defines a throughbore to permit fluid passage therethrough.

56. An expandable drill bit comprising:

a body;

at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure; and an actuating mechanism for actuating the at least one cutter between the first and second configurations, wherein the actuating mechanism includes a cam profile and piston configurable to retain the at least one cutter in at least one intermediate position between the first and second configurations.

57. An expandable drill bit comprising:

a body;

at least one cutter mounted on the body, the at least one cutter being movable between a smaller diameter first configuration and a larger diameter second configuration and adapted to form a bore in both the first and second configurations, wherein the at least one cutter is moved between the first configuration and the second configuration by changing drilling fluid pressure; and an actuating mechanism for actuating the at least one cutter between the first and second configurations, wherein the actuating mechanism comprises an axially movable skirt defining a piston area which, in use, is exposed to internal body fluid pressure, such that an increase in such pressure tends to extend the skirt, and thus move the at least one cutter towards the second configuration.

58. A drilling method comprising:

providing an expandable drill bit comprising a body and at least one cutter mounted on the body, the at least one cutter initially being in a smaller diameter first configuration;

mechanically locking the at least one cutter in the second configuration;

drilling a bore using the at least one cutter in the first configuration;

changing a drilling fluid pressure to move the at least one cutter from the first configuration to a larger diameter second configuration; and expanding the bore using the at least one cutter in the second configuration.

* * * * *